US012687305B2

(12) United States Patent
Chellappan

(10) Patent No.: US 12,687,305 B2
(45) Date of Patent: Jul. 21, 2026

(54) ADJUSTABLE FAN FOR A MICROWAVE APPLIANCE

(71) Applicant: Haier US Appliance Solutions, Inc., Wilmington, DE (US)

(72) Inventor: Bagawathkumar Chellappan, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 292 days.

(21) Appl. No.: 18/506,467

(22) Filed: Nov. 10, 2023

(65) Prior Publication Data

US 2025/0155133 A1 May 15, 2025

(51) Int. Cl.
*F24C 15/20* (2006.01)
*F24C 7/02* (2006.01)

(52) U.S. Cl.
CPC ..... *F24C 15/2042* (2013.01); *F24C 7/02* (2013.01)

(58) Field of Classification Search
CPC ... H05B 6/6423; H05B 6/6429; F24C 5/2042; F24C 7/02
USPC ..... 126/299 R, 21 A; 219/757; 454/49
See application file for complete search history.

(56) References Cited

U.S. PATENT DOCUMENTS

| | | | | |
|---|---|---|---|---|
| 2,456,391 | A | 12/1948 | Charles | |
| 2,710,573 | A | 6/1955 | Marker | |
| 3,064,551 | A | 11/1962 | Stalker | |
| 4,886,046 | A | 12/1989 | Welch | |
| 6,242,725 | B1 * | 6/2001 | Murata | H05B 6/6423 219/400 |
| 6,974,937 | B2 | 12/2005 | Kim | |
| 7,135,663 | B2 | 11/2006 | Kang | |
| 7,180,041 | B2 | 2/2007 | Song et al. | |
| 8,074,637 | B2 | 12/2011 | Yamauchi | |
| 2005/0011888 | A1 * | 1/2005 | Kim | H05B 6/642 219/757 |
| 2012/0083198 | A1 | 4/2012 | Sinur et al. | |
| 2022/0113034 | A1 | 4/2022 | Moore et al. | |

FOREIGN PATENT DOCUMENTS

| | | | |
|---|---|---|---|
| CN | 203518161 | U | 4/2014 |
| CN | 215860892 | U | 2/2022 |
| KR | 100671886 | B1 | 1/2007 |
| KR | 100897810 | B1 | 5/2009 |
| WO | WO2023150048 | A1 | 8/2023 |

OTHER PUBLICATIONS

Owen, Jared, "How do Window Blinds work?", accessed at https://www.youtube.com/watch?v=QvLdVWS_DsM on Nov. 10, 2023, 2 pages.

* cited by examiner

*Primary Examiner* — Vivek K Shirsat
(74) *Attorney, Agent, or Firm* — Dority & Manning, P.A.

(57) ABSTRACT

A microwave appliance includes a casing that defines a cooking chamber, and a fan assembly positioned within the casing. The fan assembly includes a discharge housing that includes a plurality of discharge ports, and a fan housing mounted within the discharge housing. The fan housing is selectively rotatable within the discharge housing. The fan housing includes an outlet configured to align with a selected one of the plurality of discharge ports. The fan assembly further includes a fan wheel rotatably mounted within the fan housing. The fan wheel is configured to circulate air through the outlet of the fan housing and the selected one of the plurality of discharge ports.

16 Claims, 7 Drawing Sheets

ADJUSTABLE FAN FOR A MICROWAVE APPLIANCE

FIELD OF THE INVENTION

The present subject matter relates generally to microwave appliances, and more particularly to fans in over-the-range microwave appliances.

BACKGROUND OF THE INVENTION

Over-the-range microwave appliances are generally mounted above a cooktop of an oven range appliance. In addition to providing for heating of food and beverage items, certain over-the-range microwave appliances include a circulation system. When activated, the circulation system can draw fumes, smoke, grease, and/or steam away from the cooktop of the oven range appliance. Circulation systems generally include a fan for drawing a flow of air into the circulation system and a grease filter for trapping grease entering the circulation system.

Over-the-range microwave appliances generally have a radial blower fan that can be adjusted to recirculate or externally vent through an air vent. The installer of the microwave appliance can adjust the blower fan by removing certain parts to access and remove the radial blower fan, in order to reposition the fan. In other words, to switch venting directions after installation of the microwave appliance, the microwave appliance needs to be uninstalled and then reinstalled with the fan repositioned to change the venting direction. At times, installers may overlook ducting in the home and install the microwave appliance without properly orienting the blower fan to the functional position. This can lead to the failure of the magnetron and the cooking air not being vented in the desired direction for the consumer.

Accordingly, a microwave appliance with features for adjusting the circulation of the microwave appliance without uninstalling and reinstalling the fan would be useful.

BRIEF DESCRIPTION OF THE INVENTION

Aspects and advantages of the invention will be set forth in part in the following description, or may be apparent from the description, or may be learned through practice of the invention.

In a first example embodiment, a microwave appliance includes a casing that defines a cooking chamber configured for receipt of food items for cooking and a circulation conduit. The circulation conduit has an inlet and an outlet. A door is mounted to the casing and configured for permitting selective access to the chamber of the casing. A fan assembly is positioned within the casing. The fan assembly includes a discharge housing that includes a plurality of discharge ports, and a fan housing mounted within the discharge housing. The fan housing is selectively rotatable within the discharge housing. The fan housing includes an outlet configured to align with a selected one of the plurality of discharge ports. The fan assembly further includes a fan wheel rotatably mounted within the fan housing. The fan wheel is configured to circulate air through the outlet of the fan housing and the selected one of the plurality of discharge ports.

In a second example embodiment, a fan assembly is configured to be positioned within a casing of an appliance. The fan assembly includes a discharge housing that includes a plurality of discharge ports, and a fan housing mounted within the discharge housing. The fan housing is selectively rotatable within the discharge housing. The fan housing includes an outlet configured to align with a selected one of the plurality of discharge ports. The fan assembly further includes a fan wheel rotatably mounted within the fan housing. The fan wheel is configured to circulate air through the outlet of the fan housing and the selected one of the plurality of discharge ports.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
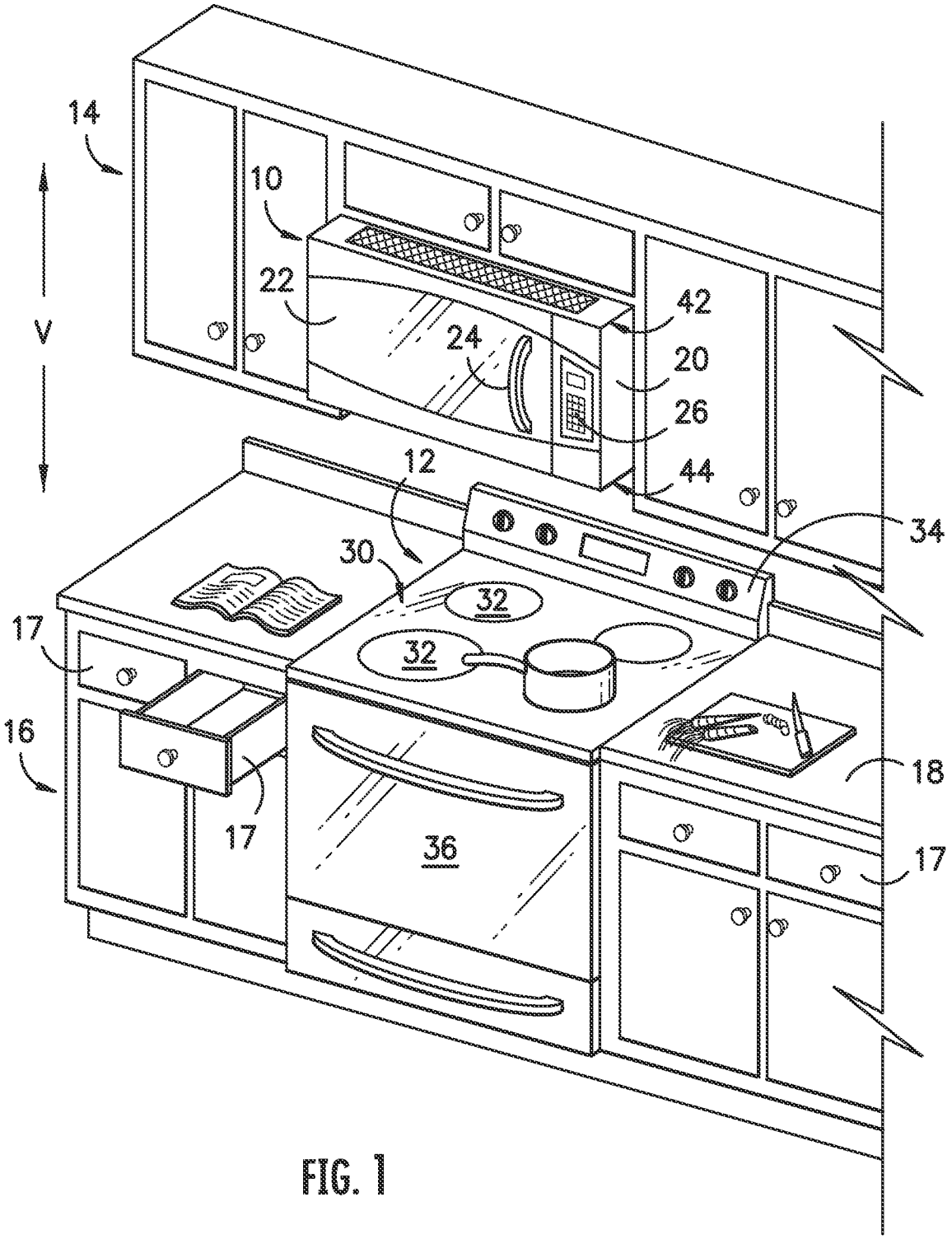
FIG. 1 provides a perspective view of a microwave appliance according to an example embodiment of the present subject matter mounted to a kitchen cabinet above an oven range appliance.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a microwave appliance 10 according to an example embodiment of the present subject matter mounted to an upper set of kitchen cabinets 14 above an oven range appliance 12, e.g., along a vertical direction V. Microwave appliance 10 shown in FIG. 1 is commonly referred to as an over-the-range microwave. It should be understood that, in alternative example embodiments, the present subject matter may be used in any other suitable microwave appliance.

As discussed above, microwave appliance 10 is mounted to upper set of kitchen cabinets 14. Upper set of kitchen cabinets 14 is positioned above a base set of kitchen cabinets 16, e.g., along the vertical direction V. Base set of kitchen cabinets 16 includes countertops 18 and drawers 17. Microwave appliance 10 is positioned above base set of kitchen cabinets 16, e.g., along the vertical direction V. Oven range appliance 12 is received within base set of kitchen cabinets 16 below microwave appliance 10. In particular, a cooking surface 30 of oven range appliance 12 is positioned, e.g., directly, below microwave appliance 10 along the vertical direction V. Microwave appliance 10 can include features such as an air handler or fan assembly 52 (FIG. 2) that can draw cooking vapors and/or smoke away from cooking surface 30 and out of the kitchen containing microwave and oven range appliances 10 and 12.

Microwave appliance 10 is configured for receipt of food items for cooking. In particular, microwave appliance 10 includes a cabinet or casing 20 and a door 22 that permits selective access to an interior of microwave appliance 10 and casing 20. Door 22 includes a handle 24 that a user can pull to open door in order to insert food items into microwave appliance 10. Microwave appliance 10 also includes controls 26 that permit a user to make selections for cooking of food items, e.g., a duration of a cooking cycle of microwave appliance 10 and/or a power setting for the cooking cycle of microwave appliance 10.

As discussed above, oven range appliance 12 includes cooking surface 30. Cooking surface 30 includes heated portions 32 that may be heated by heating elements (not shown), e.g., electrical resistive heating elements, gas burners, induction heating elements, and/or any other suitable heating element of combination of heating elements. Oven range appliance 12 also includes a door 36 that permits access to a heated compartment (not shown) of oven range appliance 12, e.g., for cooking or baking of food items therein. A control panel 34 of oven range appliance 12 can permit a user to make selections for cooking of food items, e.g., a duration of a cooking cycle of oven range appliance 12 and/or a power setting for the cooking cycle of oven range appliance 12.

Figure 2:
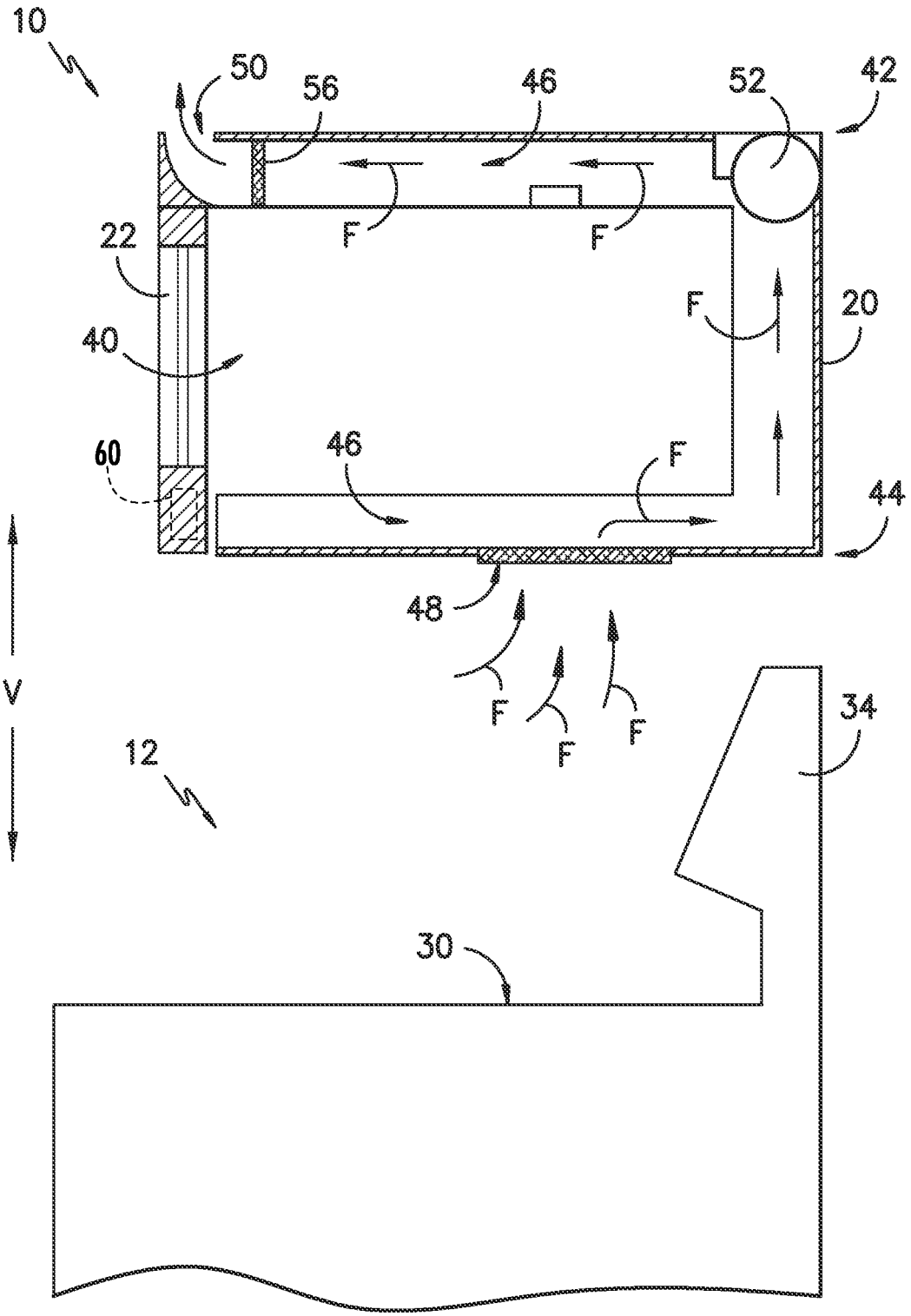
FIG. 2 provides a side, section view of the example microwave appliance and the oven range appliance of FIG. 1.
Figure 3:
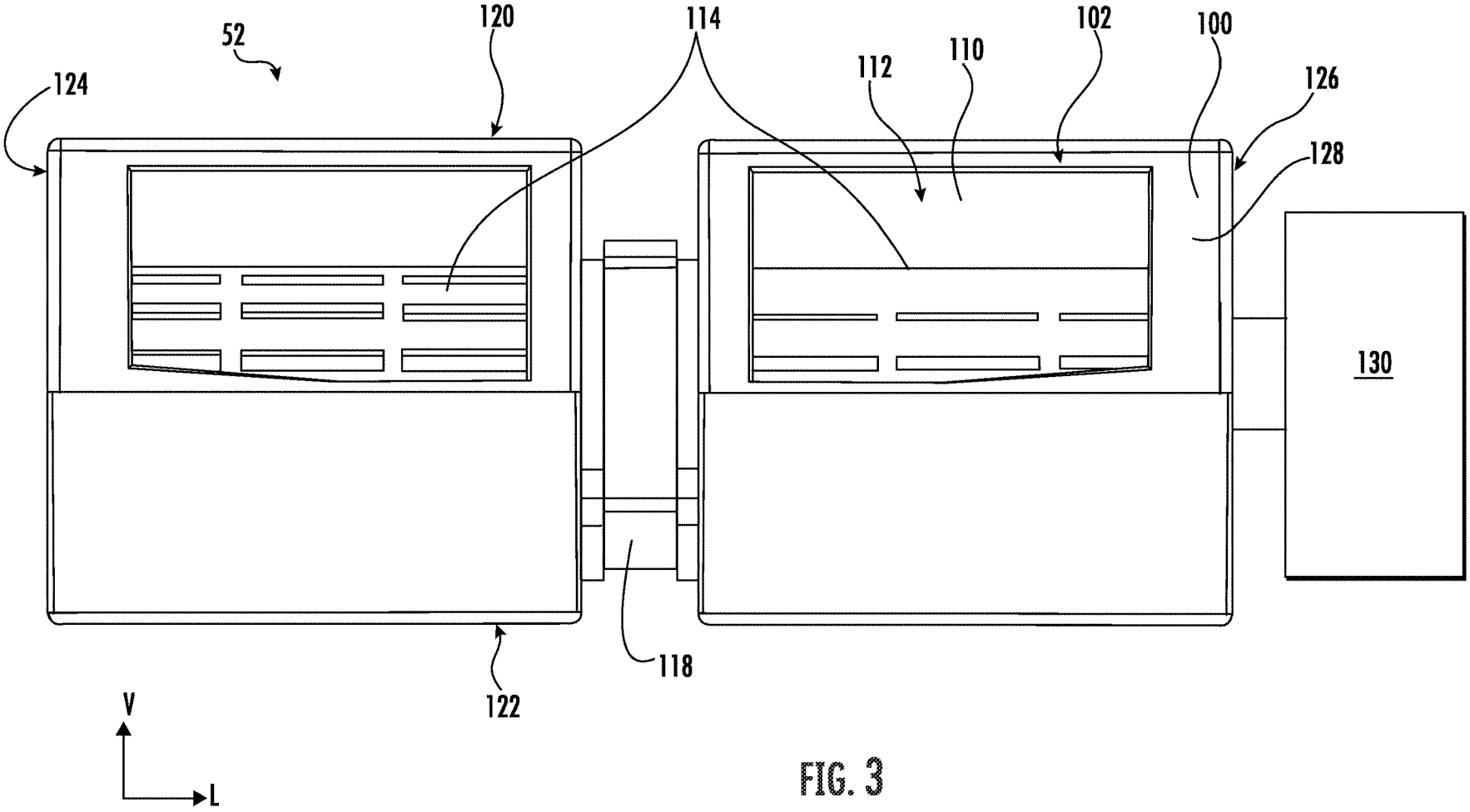
FIG. 3 provides a front view of a fan assembly of the example microwave appliance of FIG. 1.

FIG. 2 provides a side, section view of microwave appliance 10 and oven range appliance 12. As may be seen in FIG. 2, casing 20 extends between a top portion 42 and a bottom portion 44, e.g., along the vertical direction V. Thus, top and bottom portions 42 and 44 of casing 20 are spaced apart from each other, e.g., along the vertical direction V. Casing 20 defines a cooking chamber 40 configured for receipt of food items for cooking. Door 22 of microwave appliance 10 permits selective access to cooking chamber 40 of casing 20. In particular, door 22 of microwave appliance 10 is selectively adjustable between an open position (not shown) and a closed position (FIGS. 1 and 2). In the closed position, door 22 of microwave appliance 10 hinders access to cooking chamber 40 of casing 20. Conversely, door 22 of microwave appliance 10 permits access to cooking chamber 40 of casing 20 in the open position. A user can pull on handle 24 of door 22 of microwave appliance 10 in order to shift door 22 from the closed position shown in FIG. 2 to the open position.

Casing 20 also defines a circulation passage or conduit 46. Circulation conduit 46 has an inlet 48 and an outlet 50. Circulation conduit 46 extends between inlet 48 and outlet 50. Inlet 48 of circulation conduit 46 is positioned at or adjacent bottom portion 44 of casing 20, e.g., such that inlet 48 of circulation conduit 46 faces cooking surface 30 of oven range appliance 12. Conversely, outlet 50 of circulation conduit 46 is positioned at or adjacent top portion 42 of casing 20, e.g., such that outlet 50 of circulation assembly 46 faces away from cooking surface 30 of oven range appliance 12. Thus, inlet 48 and outlet 50 of circulation conduit 46 are spaced apart from each other, e.g., along the vertical direction V.

Microwave appliance 10 may include a fan assembly 52, such as an axial fan or a radial fan. Fan assembly 52 may be positioned within or adjacent circulation conduit 46. Fan assembly 52 may draw or urge a flow of air (shown with arrows F) through circulation conduit 46 when fan assembly 52 is in an activated state. Conversely, fan assembly 52 may not draw or urge flow of air F through circulation conduit 46 when fan assembly 52 is in a deactivated state. When fan assembly 52 is in the activated state, flow of air F enters circulation conduit 46 at, or through, inlet 48 of circulation conduit 46. In the present example embodiment, flow of air F is directed through circulation conduit 46 to outlet 50, and flow of air F can exit circulation conduit 46 at outlet 50 of circulation conduit 46. As described above, fan assembly 52 is described in a recirculation orientation where flow of air F is directed through circulation conduit 46 to outlet 50, however, fan assembly 52 may be configurable to direct flow of air F in other desired directions. Fan assembly 52, and other possible orientations of fan assembly 52 will be described in further detail hereinbelow.

Microwave appliance 10 may also include an air filter 56. Air filter 56 may be mounted to casing 20 such that flow of air F within circulation conduit 46 passes through air filter 56 when fan assembly 52 is in the activated state. In the example embodiment shown in FIG. 2, air filter 56 is positioned within circulation conduit 46 at outlet 50 of circulation conduit 46. It should be understood that in alternative example embodiments, air filter 56 may be positioned at any other suitable location on microwave appliance 10.

As may be seen in FIG. 2, microwave appliance 10 includes a controller 60. Operation of microwave appliance 10 is regulated by controller 60. Controller 60 is operatively coupled or in communication with various components of microwave appliance 10, including controls 26. In response to user manipulation of controls 26, controller 60 operates the various components of microwave appliance 10 to execute selected cycles and features.

Controller 60 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 60 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Controls 26 and other components of microwave appliance 10 may be in communication with controller 60 via one or more signal lines or shared communication busses.

Microwave appliance 10 also includes a magnetron 62. Magnetron 62 is configured for generating microwaves and directing such microwaves towards or into cooking chamber 40 of casing 20. Magnetron 62 can be positioned at any suitable location within microwave appliance 10. For example, magnetron 62 may be mounted to casing 20, e.g., at or adjacent top portion 42 of casing 20, such that magnetron 62 is positioned at or adjacent cooking chamber 40 of casing 20. Controller 60 can selectively activate magnetron 62, e.g., in order to heat food or beverage items in cooking chamber 40, based at least in part on an activation signal received from controls 26. Further, controller 60 may also be in operative communication with fan assembly 52. Thus, controller 60 may selectively adjust fan assembly 52 between the activated and deactivated states in order to regulate the flow of air F through circulation conduit 46.

Illustrated in FIGS. 3-7 is example embodiment of fan assembly 52. As may be seen in FIGS. 3-7, fan assembly 52 may include a discharge housing 100. In general, discharge housing 100 may extend between a top side 120, a bottom side 122, a first side wall 124, a second side wall 126, a front side 128, and a back side 132, e.g., discharge housing 100 may be generally rectangular in shape. As may be seen in FIG. 3, discharge housing 100 may be divided into two sections in the lateral direction L, by a track strip 118. Track strip 118 will be described further herein. In general, discharge housing 100 may be symmetrical across track strip 118. Discharge housing 100 may generally define a plurality of discharge ports, e.g., a first discharge port 102, a second discharge port 104, and a third discharge port 106. In example embodiments, the plurality of discharge ports 102, 104, and 106 includes three discharge ports, first discharge port 102, second discharge port 104, and third discharge port 106, facing in different directions. For example, first discharge port 102 may be defined in front side 128 of discharge housing 100, second discharge port 104 may be defined in top side 120 of discharge housing 100, and third discharge port 106 may be defined in back side 132 of discharge housing 100. As may be seen in FIG. 5, the plurality of discharge ports 102, 104, and 106 may comprise a pair of discharge ports, one on each section of discharge housing 100 such that discharge housing 100 is symmetrical across track strip 118.

Figure 4:
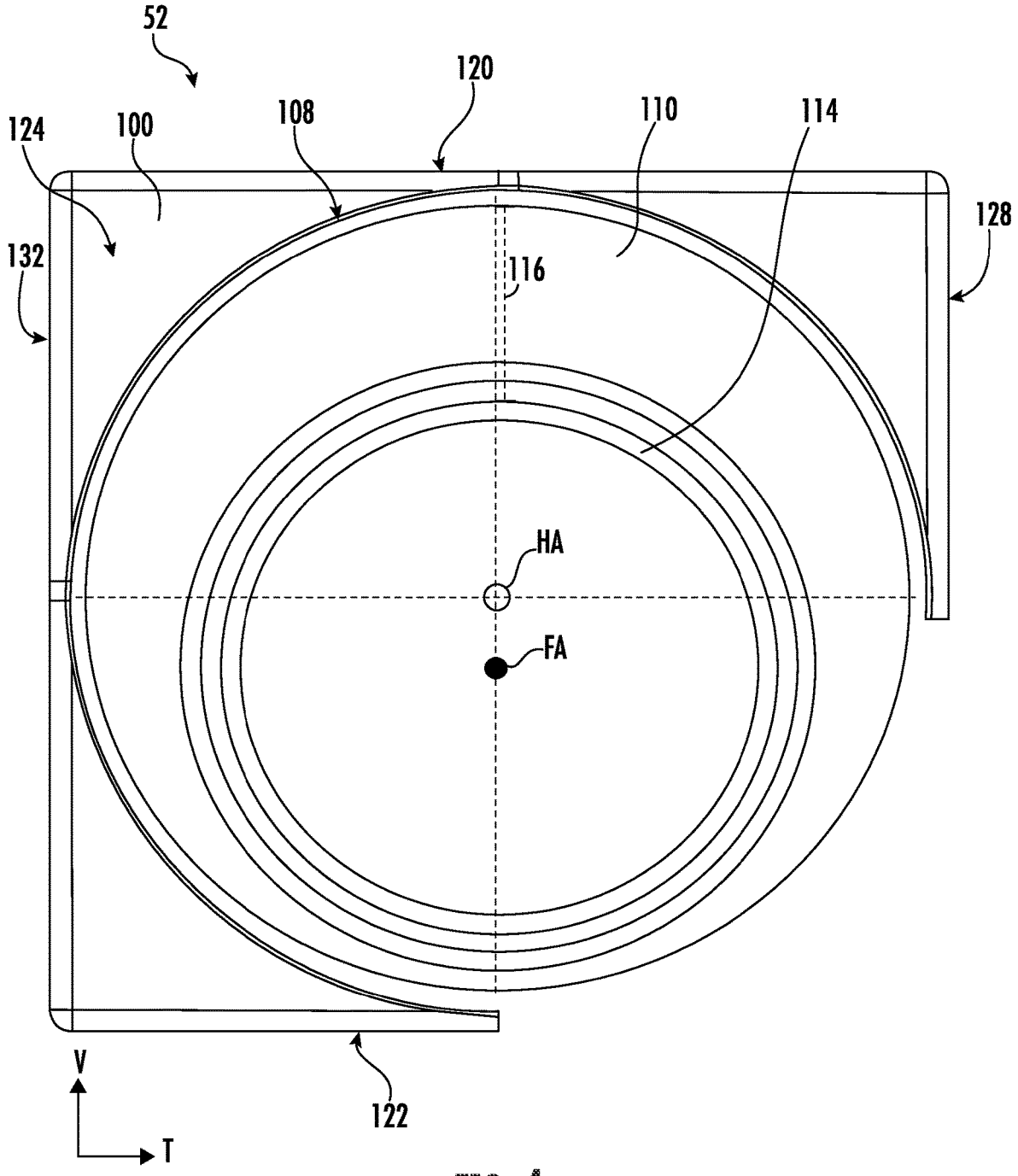
FIG. 4 provides a side view of the fan assembly of FIG. 3 according to aspects of the present disclosure.
Figure 5:
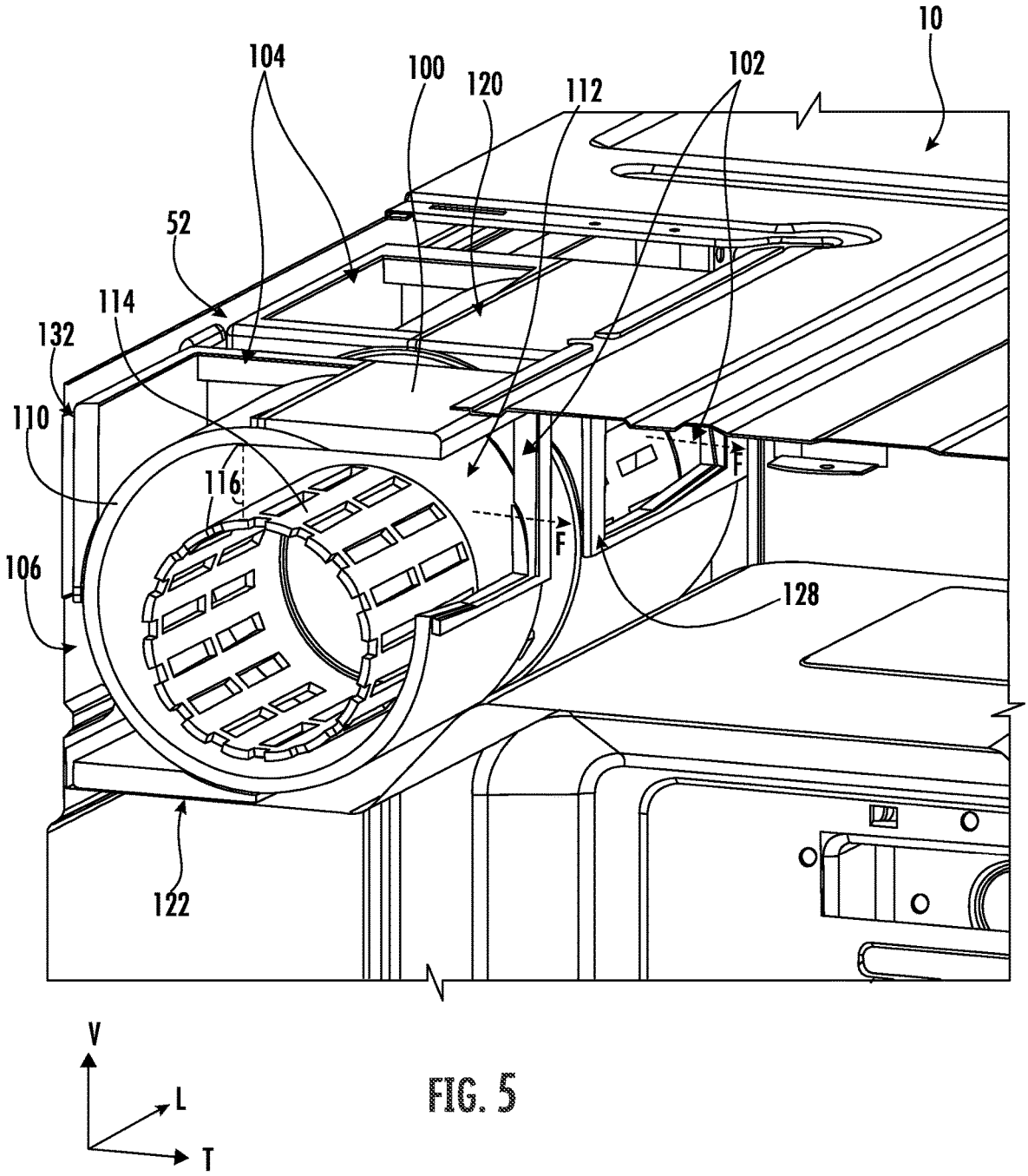
FIG. 5 provides a perspective view of an example embodiment of an example microwave appliance with the fan assembly of FIG. 3 in a first position.
Figure 6:
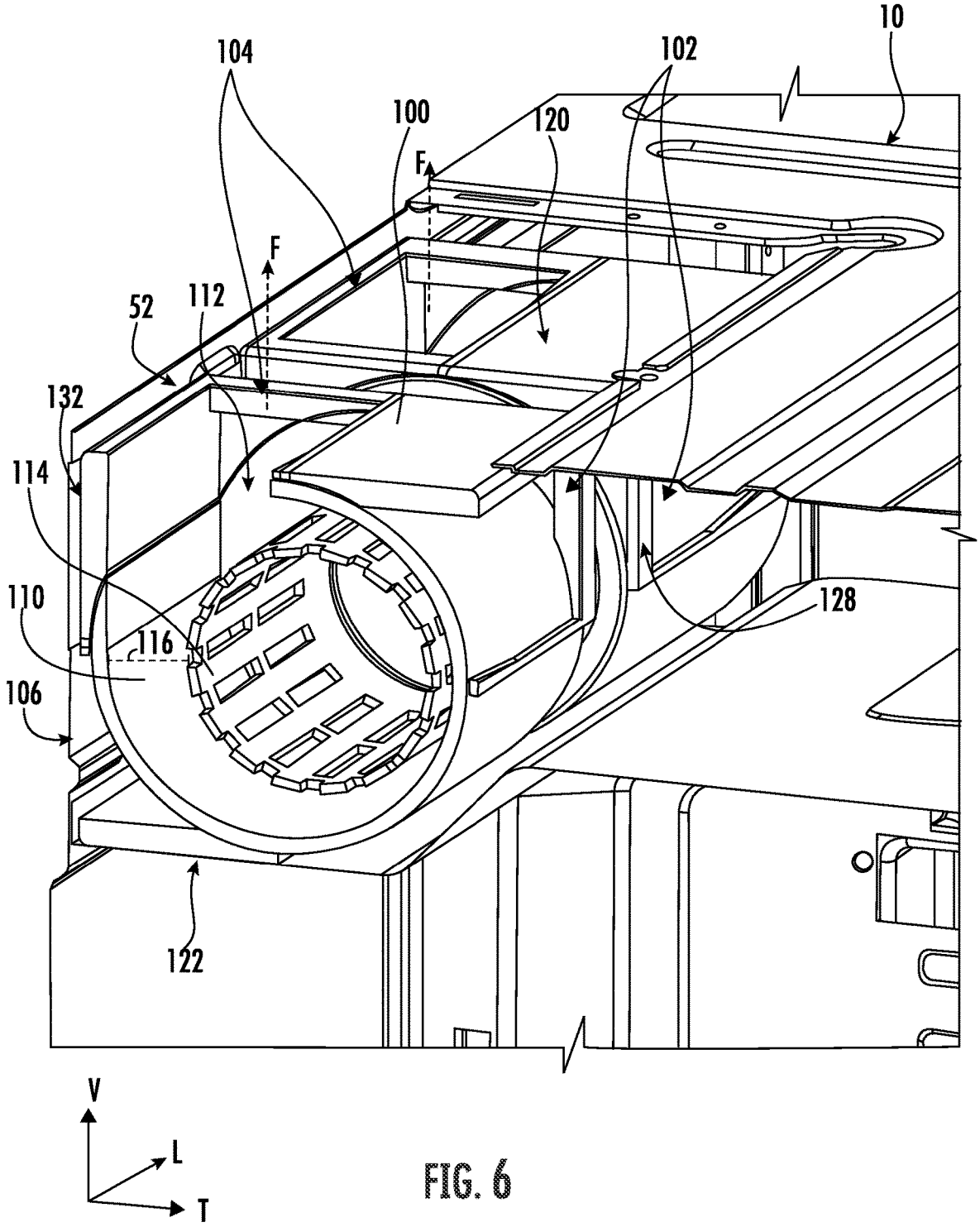
FIG. 6 provides a perspective view of an example embodiment of an example microwave appliance with the fan assembly of FIG. 3 in a second position.
Figure 7:
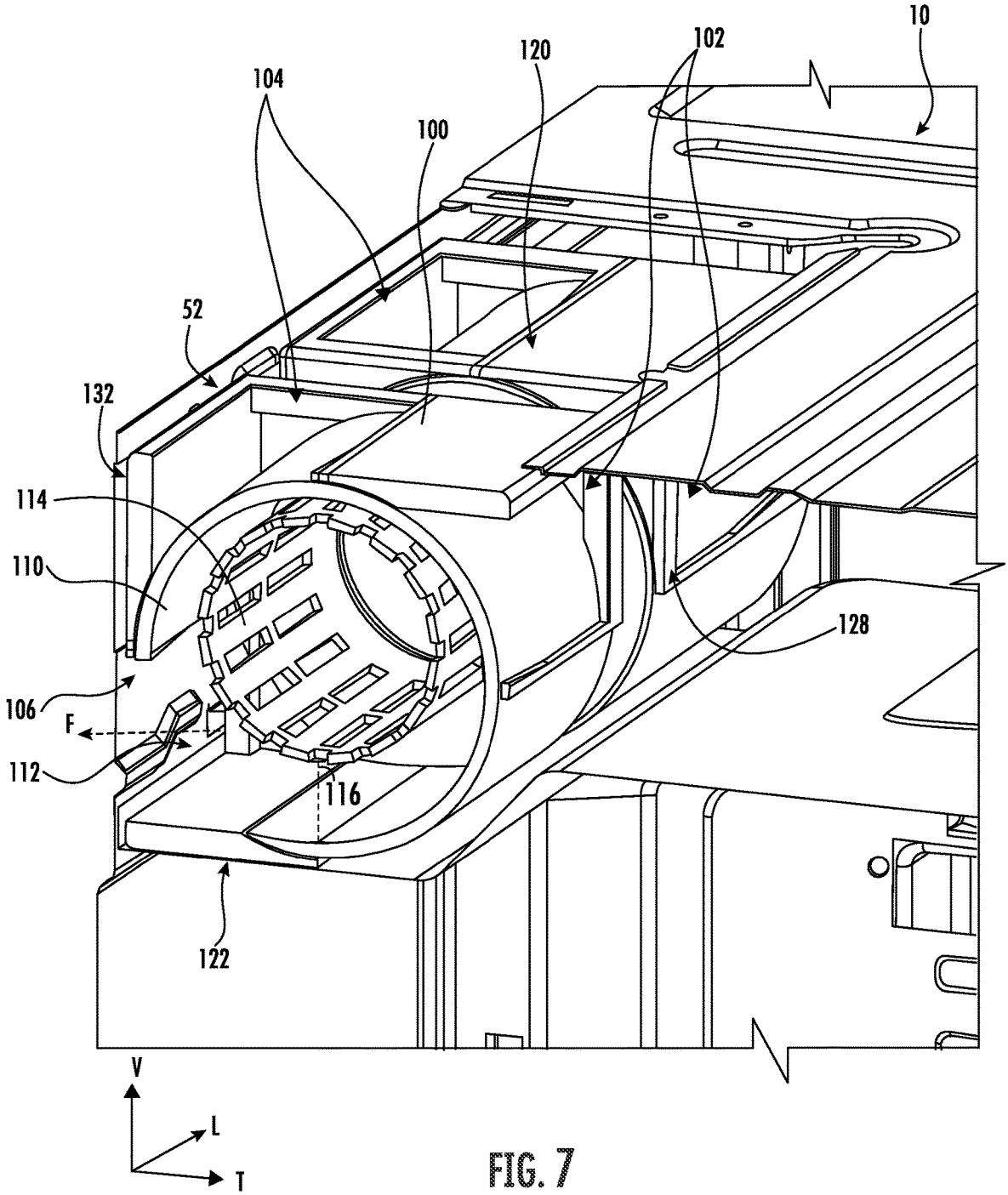
FIG. 7 provides a perspective view of an example embodiment of an example microwave appliance with the fan assembly of FIG. 3 in a third position.

As may be seen in FIG. 4, a fan housing 110 may be mounted within discharge housing 100, e.g., fan housing 110 may include two sections, one in each respective section of discharge housing 100. In particular, discharge housing 100 may include an opening 108, e.g., a cylindrically shaped opening in each of first side wall 124 and second side wall 126 of discharge housing 100. Fan housing 110 may be cylindrical, and concentric with opening 108 of discharge housing 100, such that fan housing 110 fits within opening 108 in both of the transverse direction T and vertical direction V. In other words, fan housing 110 may be laterally, in the lateral direction L, positioned within, and rotatable within, opening 108 of the discharge housing 100. For example, in the present example embodiment, fan housing 110 may be selectively rotatable within discharge housing 100. In particular, fan housing 110 may include an outlet 112, in each respective section within discharge housing 100, configured to align with a selected one of the plurality of discharge ports 102, 104, and 106. For example, fan housing 110 may be rotatable between a first position (as seen in FIG. 5), wherein outlet 112 is aligned with first discharge port 102 and flow of air F is directed through first discharge port 102, a second position (as seen in FIG. 6), wherein outlet 112 is aligned with second discharge port 104 and flow of air F is directed through second discharge port 104, and a third position (as seen in FIG. 7), wherein outlet 112 is aligned with third discharge port 106 and flow of air F is directed through third discharge port 106. Notably, fan housing 110 may be rotatable within discharge housing 100 while the discharge housing 100 and fan housing 110 are installed within microwave appliance 10.

Referring again to FIGS. 3-7, in general, fan housing 110 may include a fan wheel 114, e.g., in each section of fan housing 110. In particular, fan wheel 114 may be rotatably mounted within fan housing 110 such that fan wheel 114 may be configured to circulate air through outlet 112 of fan housing 110 and the selected one of the plurality of discharge ports 102, 104, and 106. Turning again to FIG. 4, fan wheel 114 may be mounted within fan housing 110 on a fan axis FA parallel to, and spaced apart from, a housing axis HA of the fan housing. As such, an inside gap 116 of fan housing 110 from fan wheel 114 may be non-uniform and progressively increasing towards outlet 112 of the fan housing 110. For example, as explained above, fan housing 110 may be selectively rotatable within discharge housing 100 between the plurality of discharge ports 102, 104, and 106, and offsetting fan axis FA from housing axis HA may thereby keep inside gap 116 of fan housing 110 from fan wheel 114 non-uniform and progressively increasing towards outlet 112 of fan housing 110 with respect to the selected one of the plurality of discharge ports 102, 104, and 106.

As stated above, fan housing 110 may be rotatable between a first position where outlet 112 is aligned with first discharge port 102, a second position where outlet 112 is aligned with second discharge port 104, and a third position where outlet 112 is aligned with third discharge port 106. As may be seen in FIG. 5, fan housing 110 is shown in the first position, with outlet 112 aligned with first discharge port 102. When in the first position, flow of air F may flow out of first discharge port 102 of discharge housing 100 in the transverse direction T, such that air may be recirculated through circulation conduit 46 (e.g., as seen in FIG. 2). Turning to FIG. 6, fan housing 110 is shown in the second position, with outlet 112 aligned with second discharge port 104. When in the second position, flow of air F may flow out of first discharge port 102 of discharge housing 100 in the vertical direction V, such that flow of air F may flow out an external duct (not shown) extending in the vertical direction V. Further, turning to FIG. 7, fan housing 110 is shown in the third position, with outlet 112 aligned with third discharge port 106. When in the third position, flow of air F may flow out of third discharge port 106 of discharge housing 100 in the transverse direction T, opposite the direction of the first position, such that flow of air F may flow out back side 132 of discharge housing 100 and out an external duct (not shown) in the transverse direction T.

In some example embodiments, fan assembly 52 may include track strip 118. In general, fan housing 110 may be selectively rotatable within discharge housing 100 while installed within microwave appliance 10 via rotating track strip 118. For example, track strip 118 may be a gear, or other suitable structure for rotating fan housing 110 within discharge housing 100 while the discharge housing 100 and fan housing 110 are installed within microwave appliance 10. Additionally or alternatively, fan assembly 52 may be configured to be used in other suitable appliances or structures such as heating, ventilation, and air conditioning systems (HVAC) or vent hood appliances.

As may be seen from the above, a modular discharge casing in an over-the-range microwave appliance may include a fan housing. The discharge casing may allow the fan housing to rotate therein. Additionally, the discharge casing may be equipped with multiple openings, allowing the fan housing to be rotated and aligned with any of these openings. Advantageously, the fan housing may be rotatable within the discharge casing while the discharge casing and fan housing are installed within the microwave appliance. Thus, installation and maintenance may be simplified and also flexibility may be provided for directing the airflow to specific locations or accommodating different configurations without removing the modular discharge casing from the microwave appliance, hence advantageously making the discharge casing of the over-the-range microwave appliance convenient for the users.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A microwave appliance, comprising:

a casing that defines a cooking chamber configured for receipt of food items for cooking and a circulation conduit, the circulation conduit having an inlet and an outlet;

a door mounted to the casing and configured for permitting selective access to the chamber of the casing;

a fan assembly positioned within the circulation conduit of the casing, the fan assembly comprising:

a discharge housing comprising a plurality of discharge ports;

a fan housing mounted within the discharge housing, the fan housing selectively rotatable within the discharge housing, the fan housing comprising an outlet configured to align with a selected one of the plurality of discharge ports; and a fan wheel rotatably mounted within the fan housing, the fan wheel configured to circulate air through the outlet of the fan housing and the selected one of the plurality of discharge ports, wherein the fan housing comprises a track strip, wherein the fan housing is selectively rotatable within the discharge housing while installed within the microwave appliance via rotating the track strip.

2. The microwave appliance of claim 1, wherein the plurality of discharge ports comprises three discharge ports facing in different directions.

3. The microwave appliance of claim 2, wherein the discharge housing is defined between a top side, a bottom side, a first side wall, a second side wall, a front side, and a back side.

4. The microwave appliance of claim 3, wherein one of the three discharge ports is positioned on the top side, one of the three discharge ports is positioned on the front side, and one of the three discharge ports is positioned on the back side.

5. The microwave appliance of claim 1, wherein the discharge housing comprises an opening, wherein the fan housing is cylindrical, and is concentric with the opening of the discharge housing, the fan housing positioned within the opening of the discharge housing.

6. The microwave appliance of claim 1, wherein the fan wheel is mounted within the fan housing on a fan axis parallel to, and spaced apart from, a housing axis of the fan housing.

7. The microwave appliance of claim 6, wherein an inside gap of the fan housing from the fan wheel is non-uniform and progressively increases towards the outlet of the fan housing.

8. The microwave appliance of claim 7, wherein the fan housing is selectively rotatable within the discharge housing between the plurality of discharge ports, thereby keeping the inside gap of the fan housing from the fan wheel non-uniform and progressively increasing towards the outlet of the fan housing, with respect to the selected one of the plurality of discharge ports.

9. A fan assembly configured to be positioned within a casing of an appliance, the fan assembly comprising:

a discharge housing comprising a plurality of discharge ports;

a fan housing mounted within the discharge housing, the fan housing selectively rotatable within the discharge housing, the fan housing comprising an outlet configured to align with a selected one of the plurality of discharge ports; and a fan wheel rotatably mounted within the fan housing, the fan wheel configured to circulate air through the outlet of the fan housing and the selected one of the plurality of discharge ports, wherein the fan housing comprises a track strip, wherein the fan housing is selectively rotatable within the discharge housing while installed within the microwave appliance via rotating the track strip.

10. The fan assembly of claim 9, wherein the plurality of discharge ports comprises three discharge ports facing in different directions.

11. The fan assembly of claim 10, wherein the discharge housing is defined between a top side, a bottom side, a first side wall, a second side wall, a front side, and a back side.

12. The fan assembly of claim 11, wherein one of the three discharge ports is positioned on the top side, one of the three discharge ports is positioned on the front side, and one of the three discharge ports is positioned on the back side.

13. The fan assembly of claim 9, wherein the discharge housing comprises an opening, wherein the fan housing is cylindrical, and is concentric with the opening of the discharge housing, the fan housing positioned within the opening of the discharge housing.

14. The fan assembly of claim 9, wherein the fan wheel is mounted within the fan housing on a fan axis parallel to, and spaced apart from, a housing axis of the fan housing.

15. The fan assembly of claim 14, wherein an inside gap of the fan housing from the fan wheel is non-uniform and progressively increases towards the outlet of the fan housing.

16. The fan assembly of claim 15, wherein the fan housing is selectively rotatable within the discharge housing between the plurality of discharge ports, thereby keeping the inside gap of the fan housing from the fan wheel non-uniform and progressively increasing towards the outlet of the fan housing, with respect to the selected one of the plurality of discharge ports.

* * * * *